US010465982B2

(12) United States Patent
Tang et al.

(10) Patent No.: US 10,465,982 B2
(45) Date of Patent: Nov. 5, 2019

(54) METHOD FOR NATURAL GAS LIQUEFACTION AND FILTRATION OF SOLIDIFIED CARBON DIOXIDE

(71) Applicant: GENERAL ELECTRIC COMPANY, Schenectady, NY (US)

(72) Inventors: Ching-Jen Tang, Watervliet, NY (US); Douglas Carl Hofer, Clifton Park, NY (US); Vitali Victor Lissianski, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/972,374

(22) Filed: May 7, 2018

(65) Prior Publication Data

US 2018/0252468 A1 Sep. 6, 2018

Related U.S. Application Data

(63) Continuation of application No. 14/515,854, filed on Oct. 16, 2014, now abandoned.

(51) Int. Cl.
*F25J 1/00* (2006.01)
*F25J 1/02* (2006.01)

(52) U.S. Cl.
CPC ..... *F25J 1/0022* (2013.01); *F25J 1/0055* (2013.01); *F25J 1/0212* (2013.01); *F25J 1/0265* (2013.01);
(Continued)

(58) Field of Classification Search
CPC ..... F25J 1/0212–0214; F25J 2205/20; F25J 2205/84
See application file for complete search history.

(56) References Cited

U.S. PATENT DOCUMENTS 3,254,496 A 6/1966 Roche et al.
3,724,225 A 4/1973 Mancini et al.
(Continued)

FOREIGN PATENT DOCUMENTS

DE 102009008230 A1 8/2010

OTHER PUBLICATIONS

Salako Abiodun Ebenezer.,"Removal of Carbon Dioxide From Natural Gas for LNG Production", NTNU, Semester Project work, Institute of Petroleum Technology Norwegian University of Science and Technology, Dec. 2005, 74 Pages.
(Continued)

*Primary Examiner* — Tareq Alosh
(74) *Attorney, Agent, or Firm* — Baker Hughes Patent Organization

(57) ABSTRACT

A method includes directing a refrigerant fluid mixture and a flow of natural gas through a first heat exchanger for exchanging heat between a natural gas flow path and a first refrigerant flow path. The method also includes expanding the flow of natural gas exiting from the first heat exchanger via a first throttle valve. Further, the method also includes directing a generated cold natural gas vapor and a slurry having a liquefied natural gas and solidified carbon dioxide through a filter sub-assembly. Moreover, the method also includes separating the solidified carbon dioxide by the filter sub-assembly to form a purified liquefied natural gas. Finally, the method includes directing a pulse of a cleaning fluid having at least one of methane and carbon dioxide through the filter sub-assembly to remove the solidified carbon dioxide therefrom and storing the purified liquefied natural gas in a storage tank assembly.

8 Claims, 4 Drawing Sheets

Figure 1:
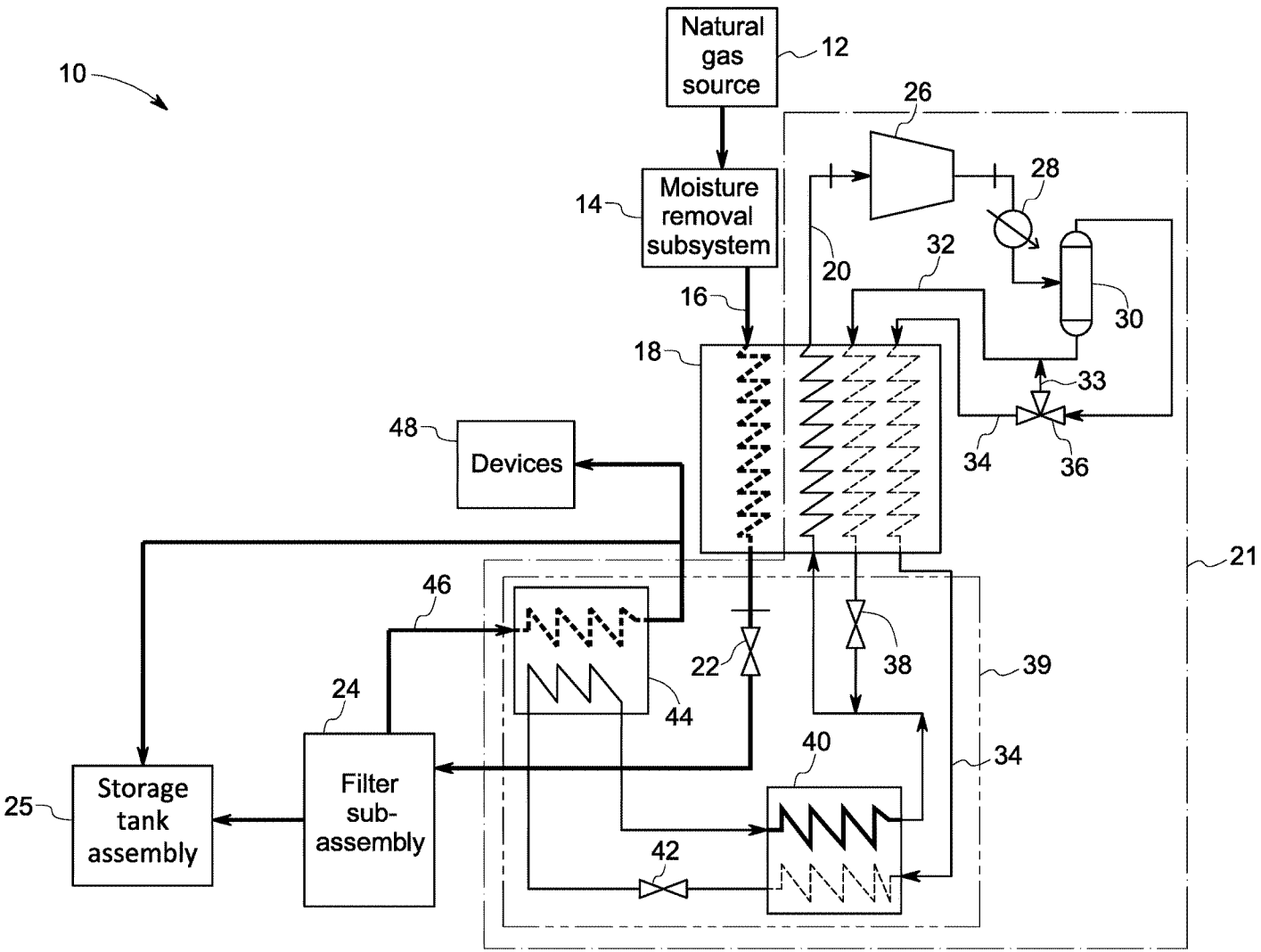

(52) U.S. Cl.
CPC ..... *F25J 2205/20* (2013.01); *F25J 2205/84* (2013.01); *F25J 2220/66* (2013.01); *F25J 2240/40* (2013.01); *F25J 2240/60* (2013.01)

(56) References Cited

U.S. PATENT DOCUMENTS

| | | | | |
|---|---|---|---|---|
| 6,250,105 | B1 | 6/2001 | Kimble | |
| 6,347,531 | B1 | 2/2002 | Roberts et al. | |
| 6,530,240 | B1 | 3/2003 | Kountz et al. | |
| 7,552,598 | B2 | 6/2009 | Paradowski | |
| 8,806,891 | B2 | 8/2014 | Brendeng et al. | |
| 9,003,828 | B2 | 4/2015 | Bridgwood | |
| 2007/0017250 | A1* | 1/2007 | Turner ..... | F25J 1/0204 62/613 |
| 2010/0313597 | A1 | 12/2010 | Bridgwood | |
| 2012/0023947 | A1 | 2/2012 | Kulkarni et al. | |
| 2013/0219955 | A1 | 8/2013 | Yoo et al. | |
| 2013/0263623 | A1 | 10/2013 | Lee et al. | |
| 2013/0340475 | A1 | 12/2013 | Turner et al. | |
| 2014/0069931 | A1 | 3/2014 | Kim et al. | |

OTHER PUBLICATIONS

Yumei et al., "Optimization Analysis of the Mixed Refrigerant Cycle to Liquefy the Natural Gas", Journal of Engineering Thermophysics, vol. 21, No. 4, Jul. 2000, 4 Pages.

Lin et al., "Natural Gas Pressurized Liquefaction Process Adopting MR Refrigeration and CO2 Removal by Anti-Sublimation", Institute of Refrigeration and Cryogenics, Shanghai 2002 40, China, 9 Pages.

International Invitation to Pay Additional Fees issued in connection with corresponding PCT Application No. PCT/US2015/050326 dated Dec. 17, 2015.

International Search Report and Written Opinion issued in connection with corresponding PCT Application No. PCT/US2015/050326 dated May 4, 2016.

* cited by examiner

METHOD FOR NATURAL GAS LIQUEFACTION AND FILTRATION OF SOLIDIFIED CARBON DIOXIDE

CROSS REFERENCE TO RELATED APPLICATIONS

This patent application is a continuation of co-pending U.S. patent application Ser. No. 14/515,854 filed on Oct. 16, 2014, which is incorporated by reference herein in its entirety.

BACKGROUND

The present specification relates generally to liquid natural gas production and, in particular, to a method for natural gas liquefaction and filtration of solidified carbon dioxide.

Generally, natural gas refers to a methane-rich gas mixture that can include carbon dioxide, nitrogen, hydrogen sulfide, other hydrocarbons, and moisture in various proportions. In at least some known applications, natural gas is used as an alternative to other known fuels such as gasoline and diesel. To be used as an alternative fuel, or to facilitate storage and/or transport, natural gas is typically processed to convert the natural gas into liquefied natural gas (LNG). Typically liquefying natural gas includes cooling the natural gas to about the liquefaction temperature of methane, which is about −161° C. under atmospheric pressure. However, since some commonly found constituents of natural gas (e.g., moisture and carbon dioxide) have higher freezing points than methane, solidification of the constituents may occur when cooled to the liquefaction temperature of methane, thereby forming a LNG-rich slurry. The LNG-rich slurry is generally unsuitable for use as alternative fuel. Impurities freezing in a heat exchanger during natural gas liquefaction also can cause operational problems during LNG production.

Conventional methods of forming purified LNG typically includes removing $CO_2$ in the raw natural gas before cooling it to the liquefaction temperature of methane. However, known removal systems are costly to implement and generally have a relatively large ecological and/or physical footprint. Other known methods of forming purified LNG include removing the solidified $CO_2$ from LNG via gravity separation and/or cyclone separation. However, while such removal methods are generally effective at removing relatively large solidified $CO_2$ particles from the LNG-rich slurry, they are less effective at removing smaller particles.

Therefore, there is need for an improved method for natural gas liquefaction and filtration of solid carbon dioxide particles.

BRIEF DESCRIPTION

In accordance with an embodiment of the present specification, a method includes directing a refrigerant fluid mixture and a flow of natural gas through a first heat exchanger for exchanging heat between a natural gas flow path and a first refrigerant flow path of a refrigerant cycle subsystem. The method also includes expanding the flow of natural gas exiting from the first heat exchanger via a first throttle valve resulting in formation of cold natural gas vapor and a slurry including a liquefied natural gas and solidified carbon dioxide. Further, the method also includes directing the cold natural gas vapor and the slurry including the liquefied natural gas and the solidified carbon dioxide through a filter sub-assembly. Moreover, the method also includes separating the solidified carbon dioxide by the filter sub-assembly to form a purified liquefied natural gas. Finally, the method includes directing a pulse of a cleaning fluid including at least one of methane and carbon dioxide through the filter sub-assembly to remove the solidified carbon dioxide therefrom and storing the purified liquefied natural gas in a storage tank assembly.

DRAWINGS

Figure 2:
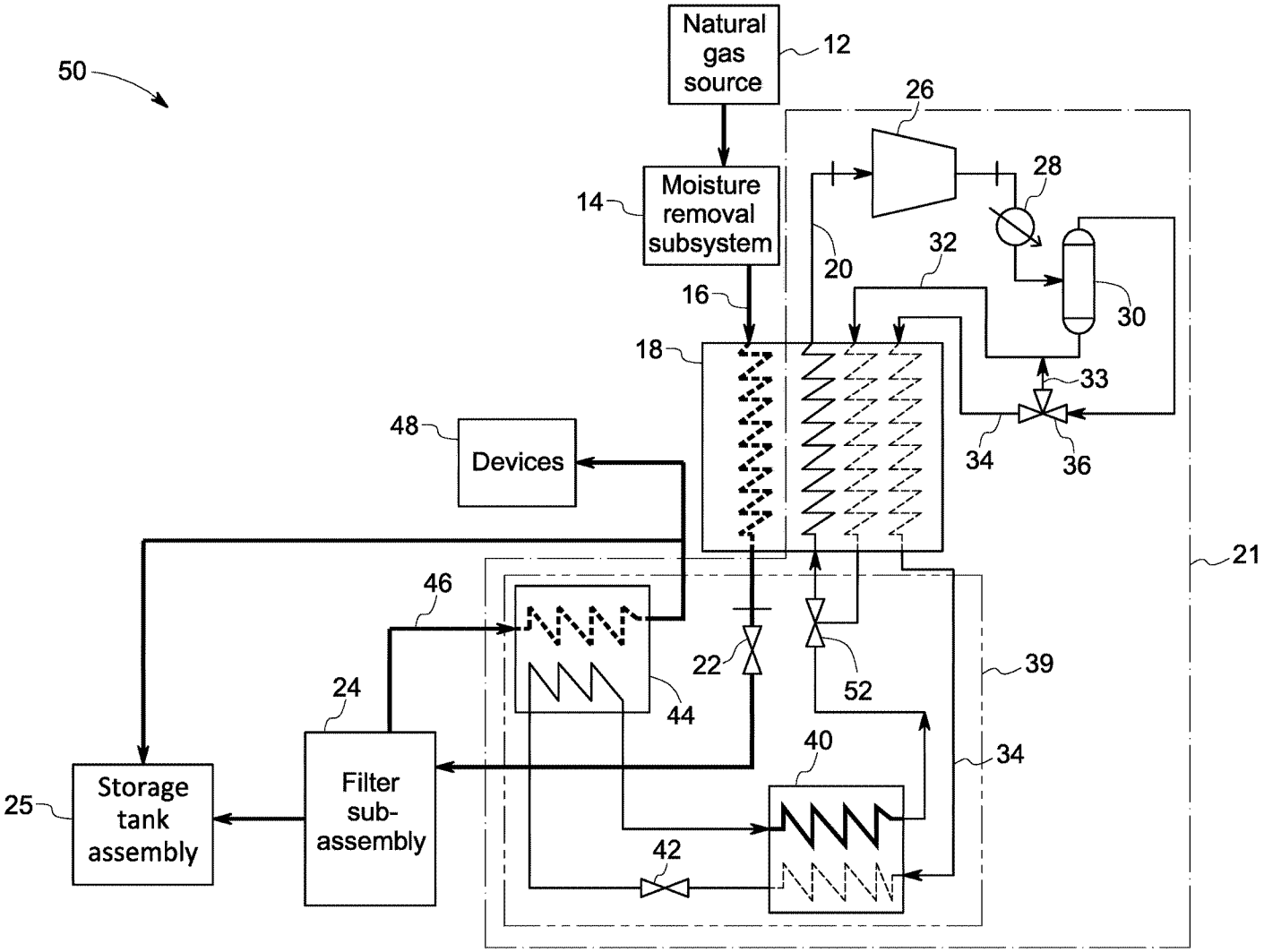
Figure 3:
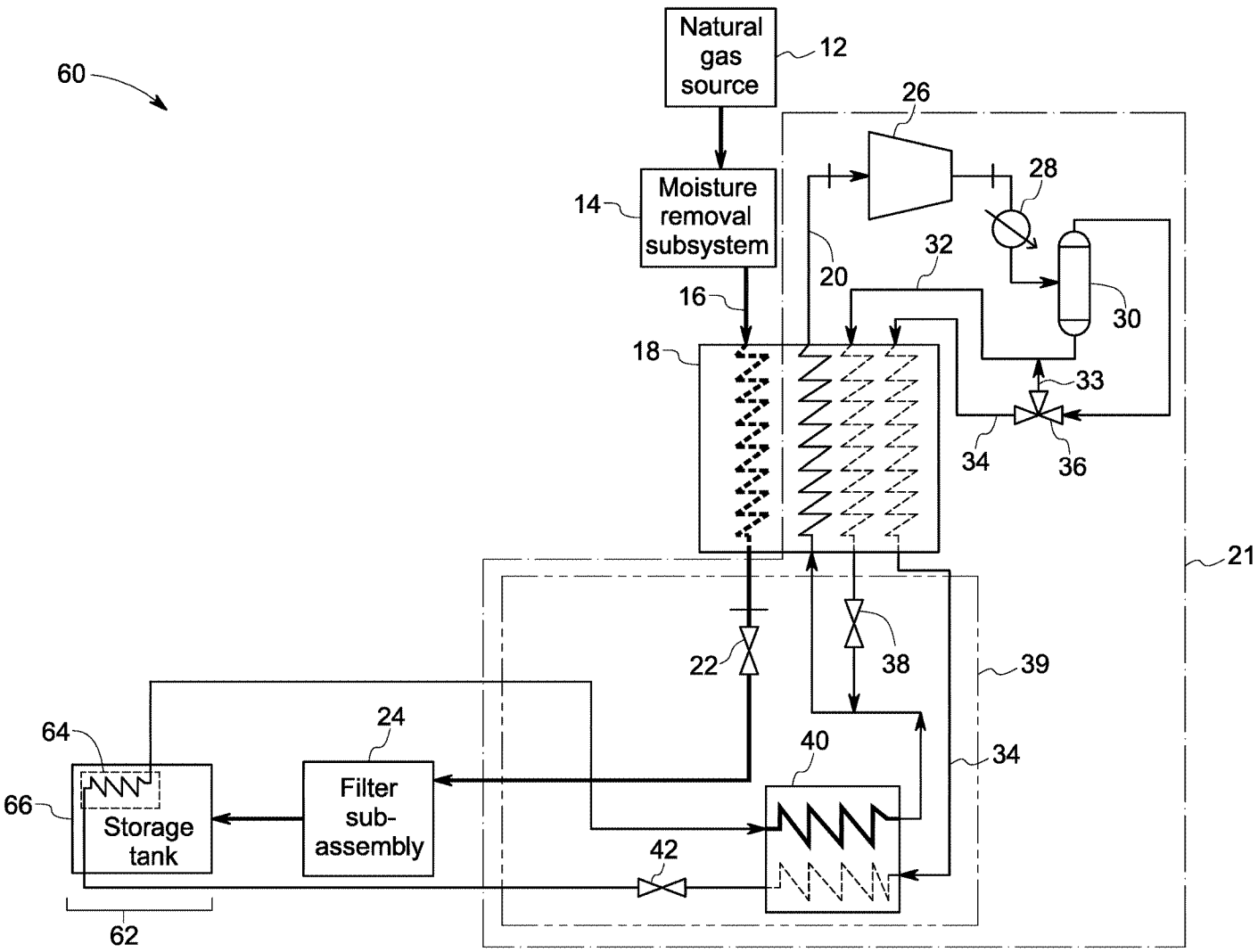
Figure 4:
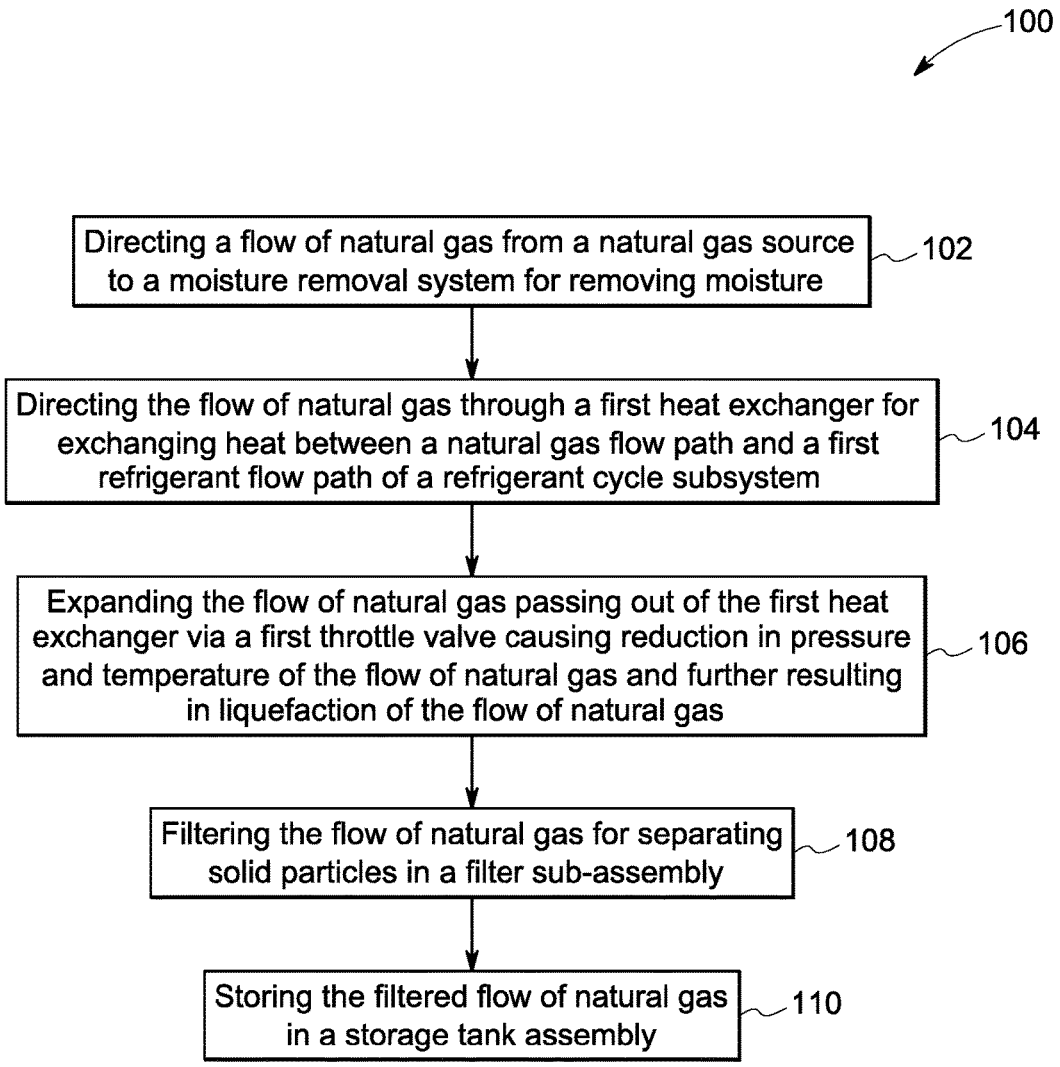

These and other features, aspects, and advantages of the present specification will become better understood when the following detailed description is read with reference to the accompanying drawings in which like characters represent like parts throughout the drawings, wherein:

FIG. 1 schematically shows an exemplary liquefaction system, in accordance with an embodiment of the present specification;

FIG. 2 schematically shows an exemplary liquefaction system, in accordance with another embodiment of the present specification;

FIG. 3 schematically shows an exemplary liquefaction system, in accordance with yet another embodiment of the present specification; and FIG. 4 is a flow chart of a method of liquefying natural gas, in accordance with an embodiment of the present specification.

DETAILED DESCRIPTION

When introducing elements of various embodiments of the present technology, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed examples.

FIG. 1 schematically shows an exemplary liquefaction system 10, in accordance with an example of the present specification. The system 10 includes a natural gas source 12 for providing a flow of natural gas to a moisture removal subsystem 14 located downstream of the natural gas source 12. The moisture removal subsystem 14 is configured to remove moisture from a natural gas flow path 16 that is in fluid communication with the natural gas source 12. The system 10 also includes a first heat exchanger 18 located downstream of the moisture removal subsystem 14. The first heat exchanger 18 is a multi-path heat exchanger configured for exchanging heat between the natural gas flow path 16 and a first refrigerant flow path 20 of a refrigerant cycle subsystem 21.

The first refrigerant flow path 20 includes a refrigerant fluid mixture that is capable of absorbing latent heat from the flow of natural gas in the natural gas flow path 16 through the first heat exchanger 18. Such an absorption of latent heat facilitates liquefaction of the natural gas. In a non-limiting example, the temperature of the natural gas passing through the first heat exchanger 18 may be reduced from about 101° F. to about −170° F.

In some embodiments, the system 10 also includes at least one first throttle valve 22 coupled downstream of the first heat exchanger 18 for expanding the flow of liquefied natural gas and causing reduction in pressure and temperature of the flow of liquefied natural gas. By causing a sudden drop of temperature of the natural gas, a portion of the liquefied natural gas may turn into vapor due to Joule- Thomson effect. In addition, the sudden temperature drop turns the carbon dioxide present in the natural gas into solid particles and thus, the liquefied natural gas contains carbon dioxide particles downstream of the first throttle valve 22.

In some embodiments, the system 10 further includes a filter sub-assembly 24 for separating the solid carbon dioxide particles present in the liquefied natural gas. Specifically, a slurry including the liquefied natural gas and solidified carbon dioxide is directed towards the filter sub-assembly 24. The solidified carbon dioxide is separated by the filter sub-assembly 24 to form a flow of purified liquefied natural gas. A pulse of cleaning fluid including at least one of methane and carbon dioxide is directed through the filter sub-assembly 24 to remove the solidified carbon dioxide therefrom. This filter sub-assembly 24 is also configured to separate a vapor portion of the natural gas. The system 10 further includes a storage tank assembly 25 located downstream of the filter sub-assembly 24 for storing the liquefied natural gas.

As shown in FIG. 1, the refrigerant cycle subsystem 21 includes a compressor 26 located downstream of the first refrigerant flow path 20 and configured to compress the refrigerant fluid mixture flowing through the first refrigerant flow path 20. Compressing the refrigerant fluid mixture leads to an increase in temperature of the refrigerant fluid mixture. The refrigerant fluid mixture may then be passed through an air cooler 28 located downstream of the compressor 26 configured to cool the refrigerant fluid mixture. Cooling the refrigerant fluid mixture allows the refrigerant fluid mixture to reject heat into ambient surroundings.

In some embodiments, the refrigerant cycle subsystem 21 may also include a phase separator 30 located downstream of the air cooler 28 for separating a vapor portion from a liquid portion of the refrigerant fluid mixture. The vapor portion of the refrigerant fluid mixture includes a vapor stream composed of species with lower boiling points, e.g., lighter hydrocarbons, while the liquid portion includes a liquid stream having species with higher boiling points, e.g., heavier hydrocarbons.

Further, as shown in FIG. 1, the refrigerant cycle subsystem 21 includes a second refrigerant flow path 34 and a third refrigerant flow path 32 connected to a top end of the phase separator 30 and a bottom end of the phase separator 30 respectively. The third refrigerant flow path 32 carries the liquid portion of the refrigerant fluid mixture while the second refrigerant flow path 34 carries the vapor portion of the refrigerant fluid mixture. Each of the third refrigerant flow path 32 and the second refrigerant flow path 34 is directed through the first heat exchanger 18 for allowing heat transfer to the refrigerant fluid mixture flowing in the first refrigerant flow path 20.

In some embodiments, the refrigerant cycle subsystem 21 also includes a three-way valve 36 located downstream of the phase separator 30 in the second refrigerant flow path 34 and connects with the third refrigerant flow path 32 and the second refrigerant flow path 34. The three-way valve 36 is configured for controlling flow of the refrigerant fluid mixture in the second and the third refrigerant flow paths 34, 32. Particularly, the vapor portion of the refrigerant fluid mixture flowing in the second refrigerant flow path 34 is divided into two streams by the three-way valve 36. One vapor stream 33 is combined with the liquid portion of the refrigerant fluid mixture flowing in the third refrigerant flow path 32 and then the combined stream is directed to the first heat exchanger 18 while the remaining vapor stream with lower boiling points in the second refrigerant flow path 34 is also passed to the first heat exchanger 18.

The refrigerant cycle subsystem 21 includes one second throttle valve 38 located in the third refrigerant flow path 32 downstream of the first heat exchanger 18 for further expanding the refrigerant fluid mixture in the third refrigerant flow path 32. This causes the temperature of the refrigerant fluid mixture in the third refrigerant flow path 32 to decrease, thereby causing at least some of the refrigerant fluid mixture to become vapor due to the Joule-Thomson effect. The third refrigerant flow path 32 downstream of the second throttle valve 38 connects with a return flow path of the refrigerant cycle subsystem 21 to form the first refrigerant flow path 20 passing through the first heat exchanger 18. The return flow path carries the refrigerant fluid mixture of the second refrigerant flow path 34 after passing through a plurality of heat exchangers. Thus, the first refrigerant flow path 20 which forms a cold side of the first heat exchanger 18 absorbs heat from the second refrigerant flow path 34 and the third refrigerant flow path 32 which form a hot side of the heat exchanger 18. As shown, the refrigerant cycle subsystem 21 includes a third heat exchanger 40 located downstream of the second refrigerant flow 34 path and is configured to transfer heat from the second refrigerant flow path 34 to the return flow path of the refrigerant cycle subsystem 21. This leads to cooling of the vapor portion of the refrigerant fluid mixture flowing in the second refrigerant flow path 34.

Furthermore, the refrigerant cycle subsystem 21 includes one third throttle valve 42 located downstream of the third heat exchanger 40 for expanding the refrigerant fluid mixture flowing in the second refrigerant flow path 34. At the end of the expansion by the third throttle valve 42, the temperature of the refrigerant fluid mixture is further reduced below the temperature of the liquefied natural gas in the storage tank assembly 25. The refrigerant cycle subsystem 21 further includes a second heat exchanger 44 located downstream of the third heat exchanger 40 and is configured to transfer heat from a natural gas vapor flow path 46 to the refrigerant fluid mixture in the second refrigerant flow path 34 of the refrigerant cycle subsystem 21. The natural gas vapor flow path 46 carries the vapor portion of the natural gas after being separated in the filter sub-assembly 24 from the liquefied natural gas. As the result of the heat transfer in the second heat exchanger 44, the temperature of the refrigerant fluid mixture increases while a majority of the vapor portion of the natural gas vapor is condensed.

A cycle 39 is shown in FIG. 1 that represents this refrigeration cycle for recovering the vapor from the natural gas. A first portion of condensed natural gas from the natural gas vapor flow path 46 is directed back to the storage tank assembly 25 and a second portion of non-condensed natural gas is directed to a plurality of devices 48 for further use. In a non-limiting example, the temperature of the first portion of condensed natural gas natural gas may be about −250° F. and a pressure of about 25 pounds per square inch. After leaving the second heat exchanger 44, the refrigerant fluid mixture in the second refrigerant flow path 34 is now directed to the return flow path that enters the third heat exchanger 40 to absorb heat from a hot side. The resulting heated mixture in the return flow path is then combined with the refrigerant fluid mixture of the third refrigerant flow path 32 and the resultant combined refrigerant fluid mixture is direct back to the first heat exchanger 18 through the first refrigerant flow path 20 to complete the refrigeration cycle for vapor recovery.

FIG. 2 schematically shows another exemplary liquefaction system 50, in accordance with an example of the present specification. The liquefaction system 50 is similar to the liquefaction system 10 of FIG. 1 except that an ejector 52 is used to replace the second throttle valve 38 of FIG. 1. The ejector 52 allows further reduction of the pressure of the refrigerant fluid mixture at a hot side of the second refrigerant flow path 34 through the second heat exchanger 44 and thus, a pressure ratio across the third throttle valve 42 is larger for the liquefaction system 50 as compared to the liquefaction system 10. The larger pressure ratio can result in a larger cooling capacity. A suction side of the ejector 52 is connected to a cold side of the third heat exchanger 40. The refrigerant fluid mixture in the third refrigerant flow path 32 with higher boiling points flowing downstream of the first heat exchanger 18 is used as a motive fluid for the ejector 52.

FIG. 3 schematically shows yet another exemplary liquefaction system 60, in accordance with an example of the present specification. In this embodiment, the liquefaction system 60 is similar to the liquefaction system 10 of FIG. 1 except that a storage tank assembly 62 includes a heat exchanger 64 integrated with a storage tank 66. This liquefaction system 60 offers two advantages over the liquefaction system 10. Firstly, the integration of the of the heat exchanger 64 with the storage tank 66, reduces the parts and simplifies assembly of the system. Secondly, the heat exchanger 64 located in the storage tank assembly 66 can be used to adjust the pressure of the storage tank assembly 66.

FIG. 4 is a flow chart of a method 100 of liquefying natural gas, in accordance with an example of the present specification. At step 102, the method 100 includes directing a flow of natural gas from a natural gas source to a moisture removal system for removing moisture. At step 104, the method 100 also includes directing the flow of natural gas through a first heat exchanger for exchanging heat between the natural gas flow path and a first refrigerant flow path of a refrigerant cycle subsystem.

Further at step 106, the method 100 includes expanding the flow of natural gas passing out of the first heat exchanger via a first throttle valve causing reduction in pressure and temperature of the flow of natural gas and further resulting in liquefaction of the flow of natural gas. Furthermore, at step 108, the method 100 also includes filtering the flow of natural gas for separating solid carbon dioxide particles in a filter sub-assembly. The filtering of the flow of natural gas may include channeling a slurry including liquefied natural gas and solidified carbon dioxide towards a filter house; separating the solidified carbon dioxide on a filter element in the filter house to form a flow of purified liquefied natural gas; and directing a pulse of cleaning fluid through the filter element to remove the solidified carbon dioxide therefrom. The cleaning fluid includes at least one of methane and carbon dioxide Finally, at step 110, the method 100 includes storing the filtered flow of natural gas in a storage tank assembly.

The method 100 also includes recycling a refrigerant fluid mixture in the refrigerant cycle subsystem through the first refrigerant flow path, a second refrigerant flow path, and a third refrigerant flow path. This includes flowing the refrigerant fluid mixture with lower boiling point temperatures through a third heat exchanger and a second heat exchanger located downstream of the second refrigerant flow path. The method 100 also includes expanding the refrigerant fluid mixture flowing in second refrigerant flow path via a second throttle valve. Further, the method 100 includes expanding the refrigerant fluid mixture flowing in second refrigerant flow path via a third throttle valve located downstream of the third heat exchanger and prior to the second heat exchanger.

In accordance with the embodiments discussed herein, the exemplary liquefaction system enables removal of moisture from the natural gas upstream of the first heat exchanger prior to liquefaction. The exemplary liquefaction system also enables removing the solidified constituents such as solid carbon dioxide particles from the liquefied natural gas downstream of the first heat exchanger.

Furthermore, the skilled artisan will recognize the interchangeability of various features from different examples. Similarly, the various methods and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular example. Thus, for example, those skilled in the art will recognize that the systems and techniques described herein may be embodied or carried out in a manner that achieves or improves one advantage or group of advantages as taught herein without necessarily achieving other objects or advantages as may be taught or suggested herein.

While only certain features of the technology have been illustrated and described herein, many modifications and changes will occur to those skilled in the art. It is, therefore, to be understood that the appended claims are intended to cover all such modifications and changes as fall within the true spirit of the claimed inventions.

The invention claimed is:

1. A method, comprising:

directing a refrigerant fluid mixture and a flow of natural gas through a first heat exchanger for exchanging heat between a natural gas flow path and a first refrigerant flow path of a refrigerant cycle subsystem;

expanding the flow of natural gas exiting from the first heat exchanger via a first throttle valve resulting in formation of a cold natural gas vapor and a slurry comprising a liquefied natural gas and solidified carbon dioxide;

directing the cold natural gas vapor and the slurry comprising the liquefied natural gas and the solidified carbon dioxide through a filter sub-assembly;

separating the solidified carbon dioxide by the filter sub-assembly to form a purified liquefied natural gas;

directing a pulse of a cleaning fluid comprising at least one of methane and carbon dioxide through the filter sub-assembly to remove the solidified carbon dioxide therefrom; and storing the purified liquefied natural gas in a storage tank assembly;

directing the cold natural gas vapor and a first portion of the refrigerant fluid mixture through a second heat exchanger to transfer heat between a natural gas vapor flow path and a second refrigerant flow path of the refrigerant cycle subsystem resulting in further cooling of the cold natural gas vapor;

wherein the second heat exchanger is located downstream of the filter sub-assembly;

directing the first portion of the refrigerant fluid mixture exiting the first heat exchanger through a third heat exchanger; and directing the first portion of the refrigerant fluid mixture through the third heat exchanger via the second heat exchanger to transfer heat between the second refrigerant flow path and a return flow path of the refrigerant cycle subsystem.

2. The method of claim 1, further comprising compressing, by a compressor, the refrigerant fluid mixture flowing through the first refrigerant flow path from the first heat exchanger.

3. The method of claim 2, further comprising cooling, by an air cooler, the refrigerant fluid mixture exiting the compressor.

4. The method of claim 1, further comprising directing the flow of natural gas from a natural gas source to a moisture removal system to remove moisture from the flow of natural gas before directing the flow of natural gas through the first heat exchanger.

5. The method of claim 1, further comprising reducing, by a second throttle valve, a pressure of a second portion of the refrigerant fluid mixture flowing through a third refrigerant flow path of the refrigerant cycle subsystem, wherein the third refrigerant flow path extends through the first heat exchanger, and wherein the second throttle valve is located downstream of the first heat exchanger.

6. The method of claim 5, further comprising reducing, by a third throttle valve, the pressure of the first portion of the refrigerant fluid mixture flowing through the second refrigerant flow path, wherein the second refrigerant flow path extends through the third heat exchanger, and wherein the third throttle valve is located downstream of the third heat exchanger.

7. The method of claim 1, further comprising reducing, by an ejector, a pressure of a second portion of the refrigerant fluid mixture flowing through a third refrigerant flow path of the refrigerant cycle subsystem, wherein the third refrigerant flow path extends through the first heat exchanger, and wherein the ejector is located downstream of the first heat exchanger.

8. The method of claim 1, further comprising controlling, by a three-way valve, a flow of the first portion of the refrigerant fluid mixture through the second refrigerant flow path to a third refrigerant flow paths, wherein the three-way valve is located downstream of a phase separator and upstream of the first heat exchanger.

* * * * *